United States Patent [19]

Lollar, Sr.

[11] Patent Number: 4,504,006

[45] Date of Patent: Mar. 12, 1985

[54] NAILER FOR NAILING AT LEAST ONE NAIL PLATE TO A MEMBER

[75] Inventor: Harvey N. Lollar, Sr., Reform, Ala.

[73] Assignee: Kerr-McGee Chemical Corporation, Oklahoma City, Okla.

[21] Appl. No.: 488,978

[22] Filed: Apr. 27, 1983

[51] Int. Cl.[3] ..... B25C 7/00; B25C 5/02; B25C 5/06

[52] U.S. Cl. ..... 227/152; 227/110; 227/111; 227/99

[58] Field of Search ..... 227/99, 110, 111, 152

[56] References Cited

U.S. PATENT DOCUMENTS

| | | | |
|---|---|---|---|
| 3,181,730 | 5/1965 | Schafroth | 227/99 |
| 3,419,205 | 12/1968 | Juriet et al. | 227/152 |
| 3,540,107 | 11/1970 | Juriet et al. | 227/152 |
| 3,820,704 | 6/1974 | Stanley | 227/110 |
| 4,373,652 | 2/1983 | Matlock et al. | 227/152 X |
| 4,441,643 | 4/1984 | McCrutchen | 227/110 |

*Primary Examiner*—Paul A. Bell
*Assistant Examiner*—Taylor J. Ross
*Attorney, Agent, or Firm*—William G. Addison

[57] ABSTRACT

A nailer for nailing at least one nail plate to a member. More particularly, the nailer includes a first and a second hammer assembly, the first hammer assembly being adapted to nail a nail plate to one end of a railroad tie and the second hammer assembly being adapted to nail a nail plate to the opposite end of the railroad tie for use in repairing railroad ties.

14 Claims, 10 Drawing Figures

NAILER FOR NAILING AT LEAST ONE NAIL PLATE TO A MEMBER

BACKGROUND OF THE INVENTION

Field of the Invention

The present invention contemplates a nailer for nailing a nail plate to a member and, more particularly, but not by way of limitation, to a nailer for substantially automatically nailing at least one nail plate to a member.

DESCRIPTION OF THE PREFERRED EMBODIMENT

Figure 9:
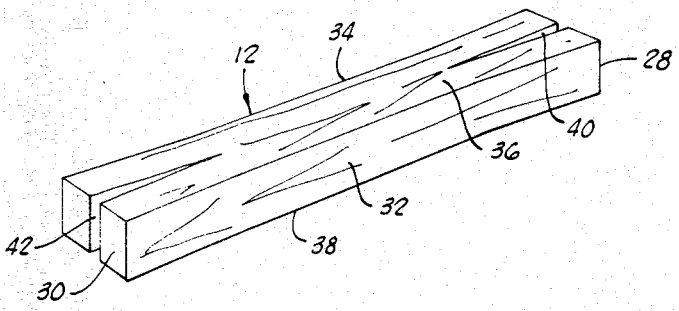
FIG. 9 is a view of a typical member of the type contemplated by the present invention to which nail plates are to be attached by the nailer.
Figure 10:
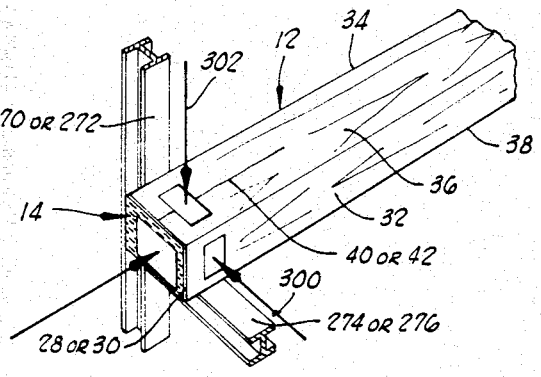
FIG. 10 is a diagrammatic, schematic view illustrating some of the forces applied to the member during the nailing operation for holding the member in a predetermined position and nailing the nail plate to the member.

Referring to the drawings in general and to FIGS. 1, 2, 3, 4, 5 and 6 in particular, shown therein and designated via the general reference numeral 10 is a nailer which is constructed in accordance with the present invention for nailing at least one nail plate to a member, a plurality of nails being secured to the nail plate and the member thereby nailing the nail plate to the member. A member of the type contemplated by the present invention is shown in FIGS. 9 and 10 and the member is shown in dashed-lines in FIGS. 2, 3, 4, 5 and 6, the member being designated by the reference numeral 12 in the drawings. A nail plate suitable for use with the nailer 10 is shown in FIGS. 7, 8 and 10 and the nail plate is designated in the drawings by the reference numeral 14.

In general, the nailer 10 includes a support table 16 having a portion adapted to receive and support the member 12; a holding assembly 18 (shown in FIGS. 2 and 6) for holding the member 12 in a predetermined position prior to nailing the nail plate 14 to the member 12; and a hammer assembly 20 for applying a force to the nails to nail the nail plate 14 to the member 12. The hammer assembly 20 includes a hammer arm assembly 22 which is pivotally supported near the support table 16 and which is pivotally moveable to a storage position and to a nailing position; a hammer mover assembly 24 for moving the hammer arm assembly 22 to the storage position and to the nailing position; and a hammer pivot assembly 26 (shown in FIGS. 1, 2 and 6) for moving the hammer arm assembly 22 into engagement with the nails when the hammer arm assembly 22 is in the nailing position to drive the nails into the member 12 thereby nailing the nail plate 14 to the member 12.

The nailer 10 of the present invention is particularly suitable for repairing certain members commonly referred to in the art as "railroad ties" and a typical member or railroad tie 12 is shown in FIG. 9. As shown in FIG. 9, the member 12 has a first end 28, a second end 30, a first side 32, a second side 34, an upper surface 36 and a lower surface 38. As shown in FIG. 9, the member or railroad tie 12 includes a split or opening 40 formed in the first end 28 thereof and extending a distance therein, and a split or opening 42 formed in the second end 30 and extending a distance therein. In use, the railroad ties 12 commonly develop splits or openings in one or both of the ends of such members 12, such as the splits or openings 40 and 42 in the member 12 shown in FIG. 9. If such splits or openings such as the openings 40 and 42 remain in the railroad tie 12, the member 12 eventually will split into two pieces along one or more of the splits or openings 40 and 42 or, at least, such splits or openings 40 and 42 will continue to enlarge to the extent such railroad tie 12 will become useless. Thus, to preserve the useability of such railroad tie 12, portions of the sides 32 and 34 are compressed generally near the ends 28 and 30, thereby reducing the split or opening 40 or 42 and a nail end plate 14 is nailed to each of the ends 28 and 30 to secure the split portions of the ends 28 and 30 in this compressed position which approximates the original dimensions of the railroad tie 12 prior to the openings 40 and 42 being formed in the ends 28 and 30.

Figure 7:
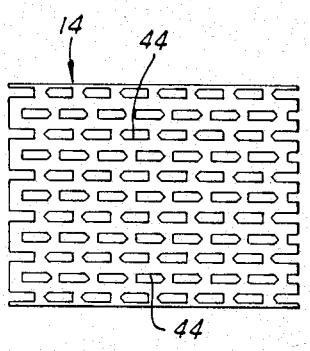
FIG. 7 is a plan view of one preferred form of the nail plate for use with the nailer of the present invention.
Figure 8:
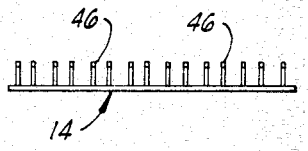
FIG. 8 is a side elevational view of the nail plate of FIG. 7.

In repairing the railroad ties 12, a particular nail plate 14 such as shown in FIGS. 7 and 8 has been utilized. As shown in FIGS. 7 and 8, this particular embodiment of the nail plate 14 has a plurality of openings 44 formed therethrough (only some of the openings 44 being designated by a reference numeral in FIG. 7). The openings 44 are formed in such a manner that the metal removed from the openings 44 remains attached to the nail plate 14 to form a plurality of nails 46 extending from one surface of the nail plate 14, as shown in FIG. 8 (only some of the nails 46 being designated by a reference numeral in FIG. 8). The construction of the nail plate 14 shown in FIGS. 7 and 8 has been used in the past to repair railroad ties 12 and, in general, such railroad ties 12 have been repaired by compressing the sides 32 and 34 of the member 12 generally adjacent each of the ends 28 and 30 and a nail plate 14, such as shown in FIGS. 7 and 8 has been nailed to each of the ends 28 and 30 to secure the ends 28 and 30 in a compressed state to reduce the possibility of further splitting along the splits or openings 40 and 42. The nailer 10 of the present invention provides a system for substantially automatically positioning the member 12, compressing the opposite ends 28 and 30 of the member 12 and nailing a nail plate 14 to each of the opposite ends 28 and 30 of the member 12, in a manner which will be described in greater detail below.

Figure 1:
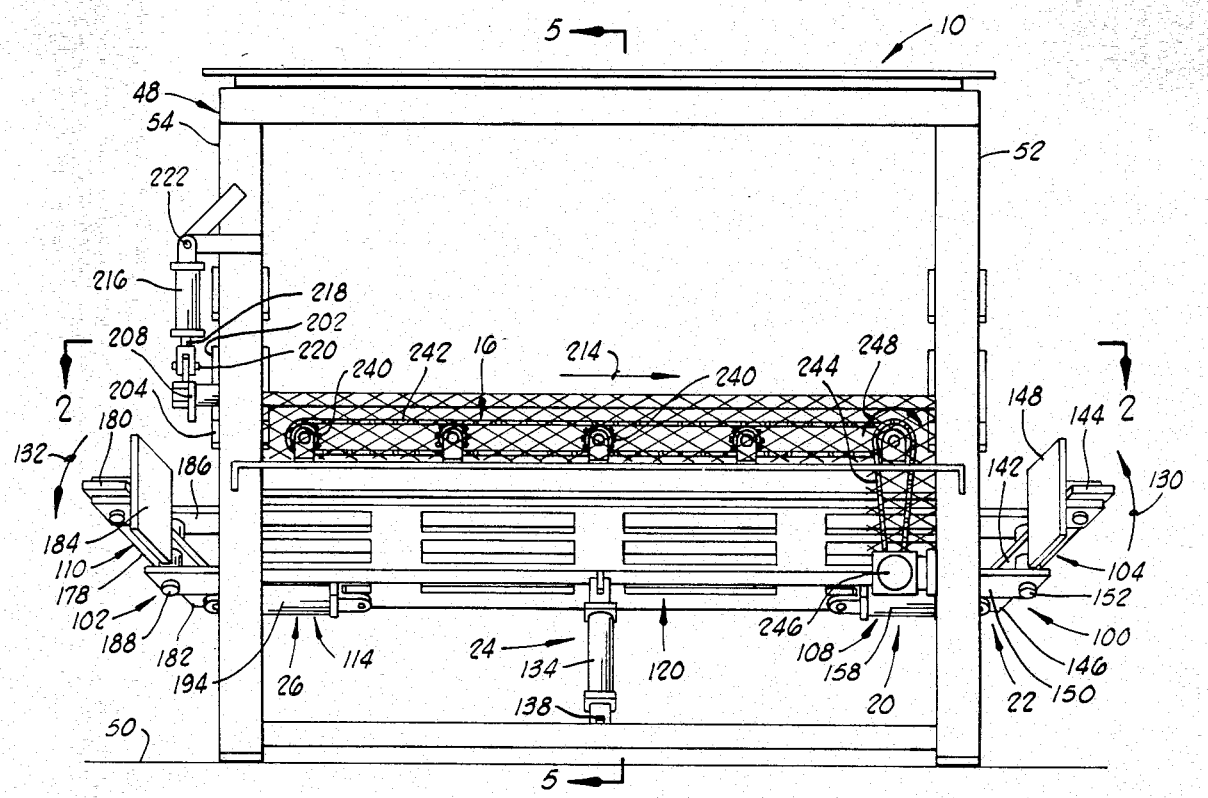
FIG. 1 is a side elevational view of a nailer which is constructed in accordance with the present invention.
Figure 6:
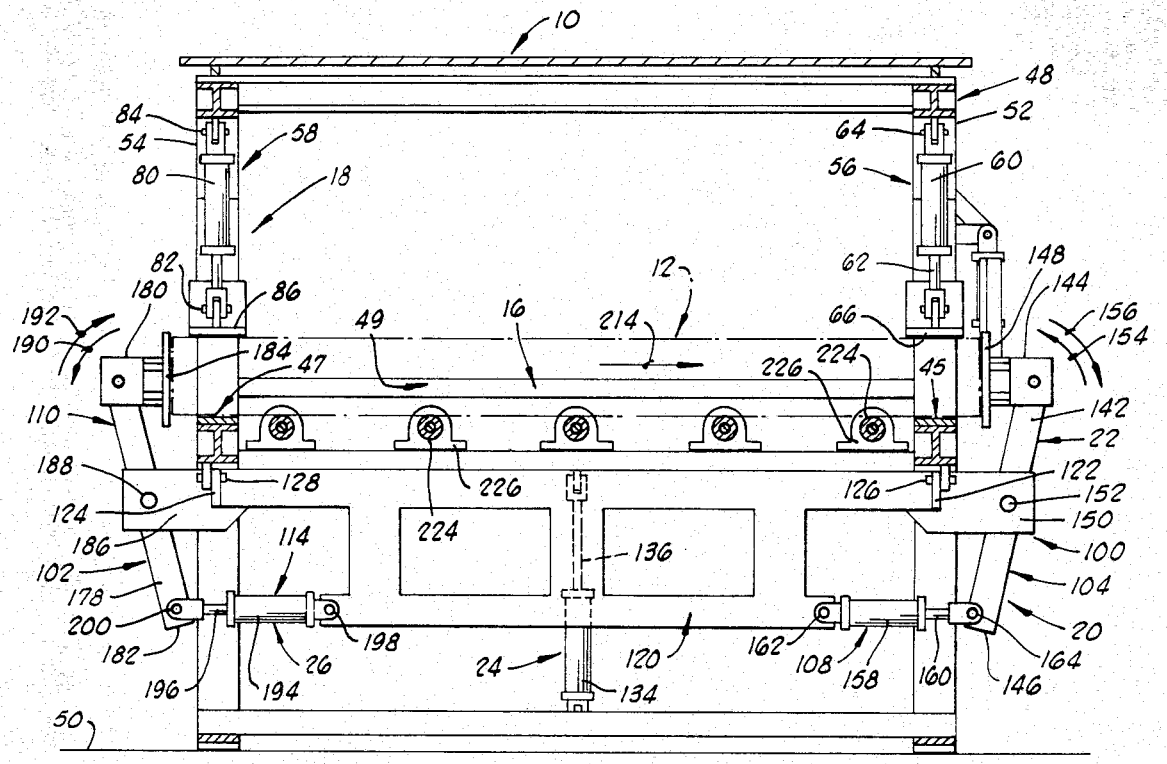
FIG. 6 is a partial sectional, partial elevational view of the nailer of FIGS. 1 and 2, taken substantially along the lines 6—6 of FIG. 4.

As shown in FIGS. 1 and 6, the support table 16 has a first end 45 and a second end 47, and the support table 16 is constructed to define a guide path 49 which extends generally between the opposite ends 45 and 47 of the support table 16. The support table 16 is adapted to support a member 14 which is disposed generally within the guide path 49 during the nailing operation.

As shown in FIGS. 1–6, the nailer 10 also includes a support frame 48. The support table 16 is connected to the support frame 48 and the support frame 48 is adapted to support the support table 16 a distance above the ground or supporting surface 50. The support frame 48 also includes structural members which are positioned to support the components of the holding assembly 18, the hammer assembly 20, the hammer arm assembly 22, the hammer mover assembly 24 and the hammer pivot assembly 26.

The support frame 48 includes a first end 52 and a second end 54 and the support frame 48 has a length which is sized to support a support table 16 of a sufficient length so that a member 12 can be positioned on the support table 16 extending generally between the opposite ends 52 and 54 of the support frame 48 and generally between the opposite ends 45 and 47 of the support table 16 for nailing a nail plate 14 to each of the opposite ends 28 and 30 of the member 12.

The holding assembly 18, more particularly, includes a first holding assembly 56 and a second holding assembly 58. The first and the second holding assemblies 56 and 58 are similar in construction. The first holding assembly 56 is supported on the support frame 48 generally near the first end 52 of the support frame 48 and the first holding assembly 56 particularly is constructed to hold the first end 28 portion of the member 12 in a predetermined position prior to and during the nailing of the nail plate 14 to the first end 28 of the member 12. The second holding assembly 58 is supported on the support frame 48 generally near the second end 54 of the support frame 48 and the second holding assembly 58 particularly is constructed and adapted to hold the second end 30 portion of the member 12 in a predetermined position prior to and during the nailing of the nail plate 14 to the second end 30 of the member 12.

Figure 3:
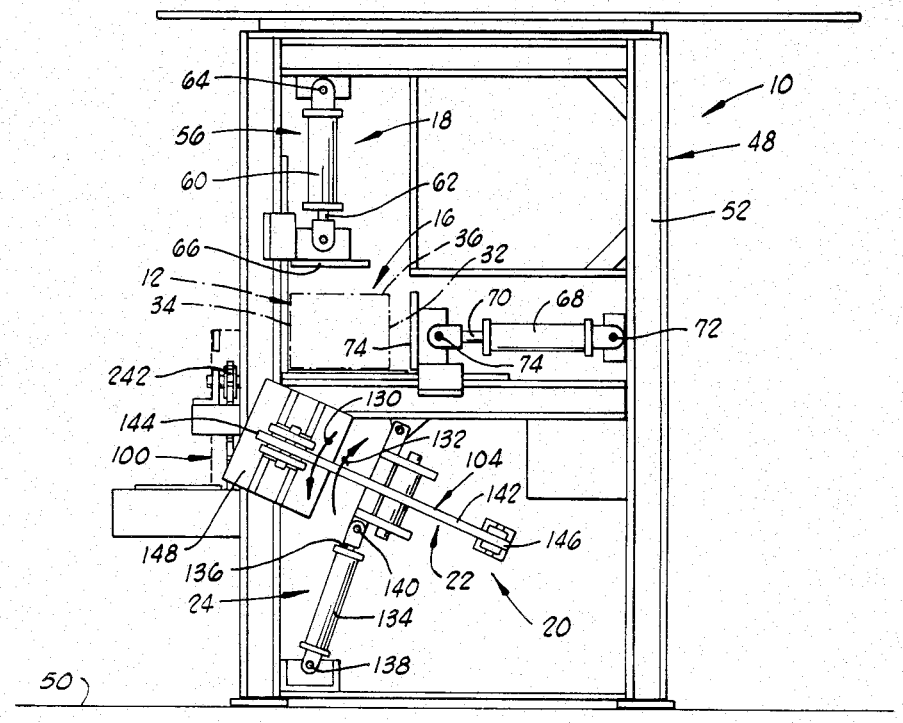
FIG. 3 is an end elevational view of the nailer of FIGS. 1 and 2 showing one end of the nailer with the hammer assembly in the storage position.
Figure 4:
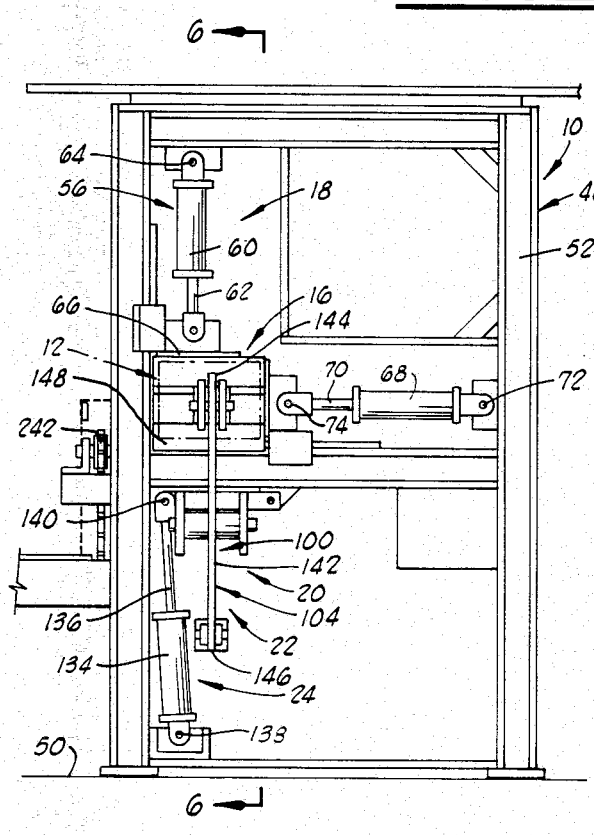
FIG. 4 is an end elevational view of the nailer of FIGS. 1 and 2, exactly like the end elevational view of FIG. 3, except showing the hammer assembly in the nailing position.
Figure 5:
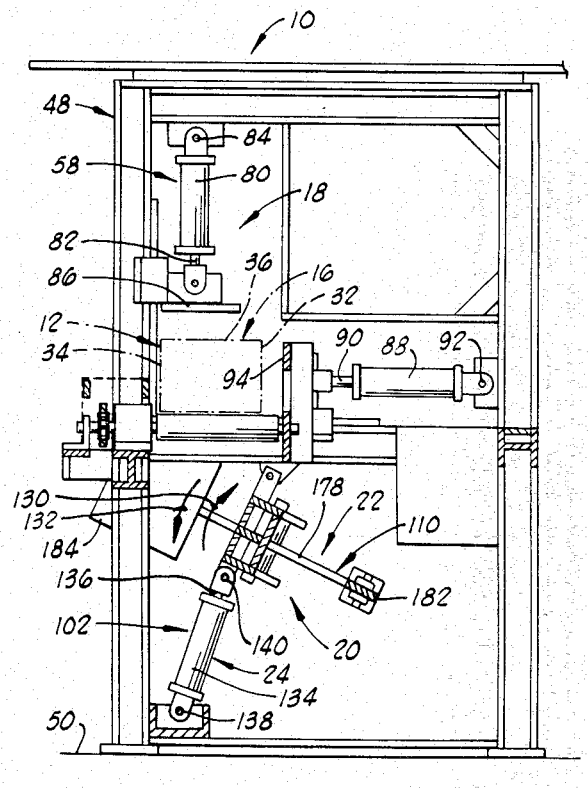
FIG. 5 is a partial sectional, partial elevational view of the nailer of FIGS. 1 and 2, taken substantially along the lines 5—5 of FIG. 1.

As shown in FIGS. 3, 4 and 5, the first holding assembly 56 includes a vertical holding cylinder 60 having one end of a rod 62 reciprocatingly disposed therein. The vertical holding cylinder 60 is secured to the support frame 48 by a pin 64, the vertical holding cylinder 60 being supported on the support frame 48 generally near the first end 52 of the support frame 48. A holding plate 66 is secured to the end of the rod 62, opposite the end of the rod 62 which is reciprocatingly disposed in the vertical holding cylinder 60.

The vertical holding cylinder 60 or, more particularly, the rod 62 is moveable to a storage position and a holding position. The vertical holding cylinder 60 is supported on the support frame 48 so that, in the storage position of the vertical holding cylinder 60 when the rod 62 has been reciprocatingly moved toward the vertical holding cylinder 60, the holding plate 66 is disposed above the support table 16 a sufficient distance so that the holding plate 66 also is disposed above the upper surface 36 of the member 12 when the member 12 is disposed and positioned on the support table 16. Further, the vertical holding cylinder 60 is supported on the support frame 48 so that, in the holding position when the rod 62 has been reciprocatingly moved away from or out of the vertical holding cylinder 60, the holding plate 66 engages the upper surface 36 portion of the member 12, generally near the first end 28 of the member 12.

Figure 2:
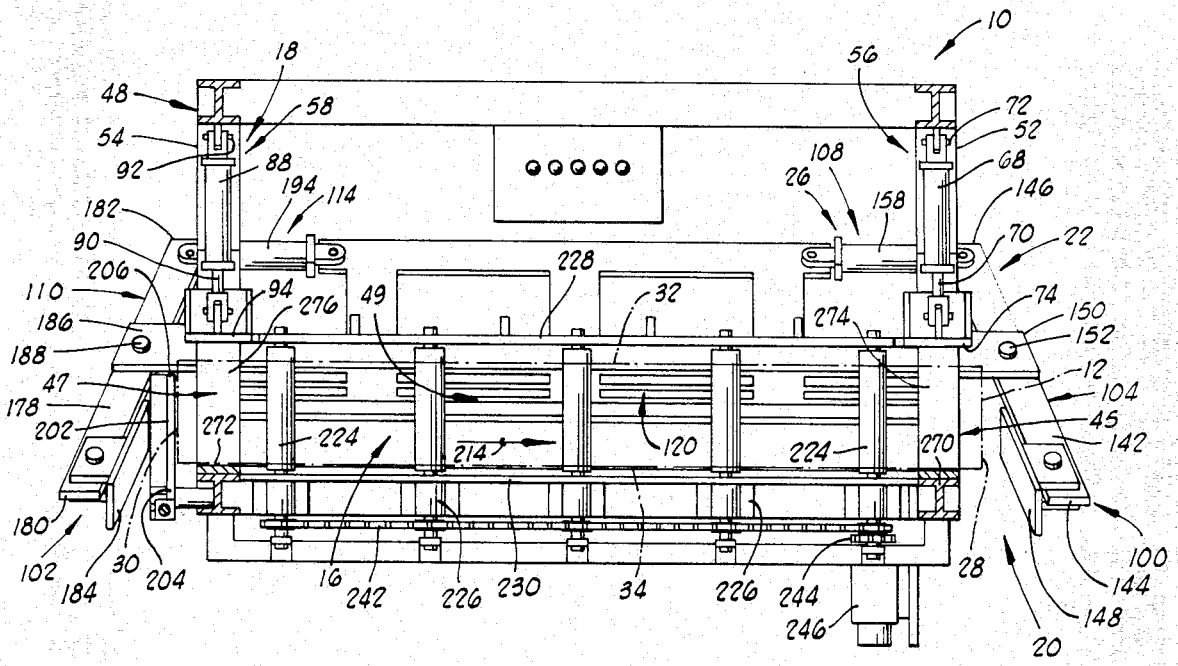
FIG. 2 is a sectional view of the nailer of FIG. 1, taken substantially along the lines 2—2 of FIG. 1.

As shown in FIGS. 2, 3 and 4, the first holding assembly 56 also includes a horizontal holding cylinder 68 having one end of a rod 70 reciprocatingly disposed therein. The horizontal holding cylinder 68 is secured to the support frame 48 by a pin 72, the horizontal holding cylinder 68 being supported on the support frame 48 generally near the first end 52 of the support frame 48. A holding plate 74 is secured to the end of the rod 70, opposite the end of the rod 70 which is reciprocatingly disposed in the horizontal holding cylinder 68.

The horizontal holding cylinder 68 or, more particularly, the rod 70 is moveable to a storage position and a holding position. The horizontal holding cylinder 68 is supported on the support frame 48 so that, in the storage position of the horizontal holding cylinder 68 when the rod 70 has been reciprocatingly moved toward the horizontal holding cylinder 68, the holding plate 74 is spaced a distance from the first side 32 of the member 12 when the member 12 is disposed and positioned on the support table 16 generally within the guide path 49. Further, the horizontal holding cylinder 68 is supported on the support frame 48 so that, in the holding position when the rod 70 has been reciprocatingly moved away from or out of the horizontal holding cylinder 68, the holding plate 74 engages the first side 32 of the member 12, generally near the first end 28 of the member 12.

As shown in FIGS. 5 and 6, the second holding assembly 58 includes a vertical holding cylinder 80 having one end of a rod 82 reciprocatingly disposed therein. The vertical holding cylinder 80 is secured to the support frame 48 by a pin 84, the vertical holding cylinder 80 being supported on the support frame 48 generally near the second end 54 of the support frame 48. A holding plate 86 is secured to the end of the rod 82, opposite the end of the rod 82 which is reciprocatingly disposed in the vertical holding cylinder 80.

The vertical holding cylinder 80 or, more particularly, the rod 82 is moveable to a storage position and a holding position. The vertical holding cylinder 80 is supported on the support frame 48 so that, in the storage position of the vertical holding cylinder 80 when the rod 82 has been reciprocatingly moved toward the vertical holding cylinder 80, the holding plate 86 is disposed above the support table 16 a sufficient distance so that the holding plate 86 also is disposed above the upper surface 36 of the member 12 when the member 12 is disposed and positioned on the support table 16. Further, the vertical holding cylinder 80 is supported on the support frame 48 so that, in the holding position when the rod 82 has been reciprocatingly moved away from or out of the vertical holding cylinder 80, the holding plate 86 engages the upper surface 36 portion of the member 12, generally near the second end 30 of the member 12.

As shown in FIGS. 2 and 5, the second holding assembly 58 also includes a horizontal holding cylinder 88 having one end of a rod 90 reciprocatingly disposed therein. The horizontal holding cylinder 88 is secured to the support frame 48 by a pin 92, the horizontal holding cylinder 88 being supported on the support frame 48 generally near the second end 54 of the support frame 48. A holding plate 94 is secured to the end of the rod 90, opposite the end of the rod 90 which is reciprocatingly disposed in the horizontal holding cylinder 88.

The horizontal holding cylinder 88 or, more particularly, the rod 90 is moveable to a storage position and a holding position. The horizontal holding cylinder 88 is supported on the support frame 48 so that, in the storage position of the horizontal holding cylinder 88 when the rod 90 has been reciprocatingly moved toward the horizontal holding cylinder 88, the holding plate 94 is spaced a distance from the first side 32 of the member 12 when the member 12 is disposed and positioned on the support table 16 generally within the guide path 49. Further, the horizontal holding cylinder 88 is supported on the support frame 48 so that, in the holding position when the rod 90 has been reciprocatingly moved away from or out of the horizontal holding cylinder 88, the holding plate 94 engages the first side 32 of the member 12, generally near the second end 30 of the member 12.

The hammer assembly 20 includes a first hammer assembly 100 which is supported on the support frame 48 generally near the first end 52 of the support frame 48 and a second hammer assembly 102 which is supported on the support frame 48 generally near the second end 54 of the support frame 48. The first hammer assembly 100 is adapted to apply a force to the nails for nailing a nail plate 14 to the first end 28 of the member 12. The hammer arm assembly 22 includes a first hammer arm assembly 104, and the hammer pivot assembly 26 includes a first hammer pivot assembly 108. The second hammer assembly 102 is supported on the support frame 48 generally near the second end 54 of the support frame 48 and the second hammer assembly 102 is adapted and positioned to apply a force to the nails to nail a nail plate 14 to the second end 30 of the member 12. The hammer arm assembly 22 includes a second hammer arm assembly 110, and the hammer pivot assembly 26 includes a second hammer pivot assembly 114.

The first hammer arm assembly 104 is pivotally secured to the support frame 48 and is moveable to a storage position and to a nailing position. The first hammer arm assembly 104 is supported on the support frame 48 and is adapted to move the first hammer arm assembly 104 to the storage position and to the nailing position. The first hammer pivot assembly 108 is secured on the support frame 48 and is adapted to move the first hammer arm assembly 104 into engagement with the nails to drive the nails into the first end 28 of the member 12 thereby nailing a nail plate 14 to the first end 28 of the member 12.

The second hammer arm assembly 110 is pivotally secured to the support frame 48 and is moveable to a storage position and to a nailing position. The second hammer arm assembly 110 is supported on the support frame 48 and is adapted to move the second hammer arm assembly 110 to the storage position and to the nailing position. The second hammer pivot assembly 114 is secured on the support frame 48 and is adapted to move the second hammer arm assembly 110 into engagement with the nails to drive the nails into the second end 30 of the member 12 thereby nailing a nail plate 14 to the second end 30 of the member 12.

As shown in FIGS. 1, 2 and 6, the hammer mover assembly 24 includes a hammer frame 120 having a first end 122 and a second end 124. The first end portion 122 of the hammer frame 120 is pivotally connected to the support frame 48 via a pin 126 generally near the first end 52 of the support frame 48 and the second end 124 portion of the hammer frame 120 is pivotally connected to the support frame 48 via a pin 128 generally near the second end 52 of the support frame 48. The hammer frame 120 thus is pivotally connected to the support frame 48 for pivotal movement in the direction 130 and in the opposite direction 132 (shown in FIG. 1, 3 and 5) for moving the first and the second hammer assemblies 100 and 102 to the nailing position and to the storage position, respectively.

As shown in FIGS. 1, 3 and 5, the hammer mover assembly 24 also includes a hammer mover cylinder 134 having one end of a rod 136 (FIGS. 3, 4 and 5) reciprocatingly disposed therein. The hammer mover cylinder 134 is pivotally connected to the support frame 48 via a pin 138 (FIGS. 3, 4 and 5) and the end of the rod 136, opposite the end of the rod 136 which is reciprocatingly disposed in the hammer mover cylinder 134, is pivotally connected to the hammer frame 120 via a pin 140 (FIGS. 3, 4 and 5). The hammer mover cylinder 134 is positioned on the support frame 48 and connected to the hammer frame 120 to pivotally move the hammer frame 120 in the direction 132 when the rod 136 is receiprocatingly moved into the hammer mover cylinder 134 to move the hammer frame 120 and the first and the second hammer assemblies 100 and 102 to the storage position, the hammer mover cylinder 134 also being connected to the support frame 48 and to the hammer frame 120 for moving the hammer frame 120 in the direction 130 for positioning the first and the second hammer assemblies 100 and 102 in the nailing position.

The first hammer arm assembly 104 includes a hammer arm 142 having opposite ends 144 and 146. A hammer plate 148 is secured to the hammer arm 142, generally near the end 144 thereof, and the hammer plate 148 is positioned on the hammer arm 142 to engage the nails for driving the nails into the first end 28 of the member 12 thereby nailing one of the end plates 14 to the first end 28 of the member 12 in the nailing position of the first hammer arm assembly 100. The hammer arm 142 is pivotally connected to one end portion of an arm frame 150 (FIGS. 1, 2 and 6) via a pin 152 (FIGS. 1, 2 and 6), and the opposite end of the arm frame 150 is secured to the hammer frame 120, generally at the first end 122 of the hammer frame 120, thereby pivotally securing the hammer arm 142 to the hammer frame 120 for pivotal movement in directions 154 and 156 (shown in FIG. 6).

The first hammer pivot assembly 108 includes a hammer pivot cylinder 158 (FIGS. 1, 2 and 6) having one end of a rod 160 (FIG. 6) reciprocatingly disposed therein. The hammer pivot cylinder 158 is pivotally connected to the hammer frame 120, generally near the first end 122 of the hammer frame 120 via a pin 162 (FIG. 6) and the end of the rod 160, opposite the end of the rod 160 which is reciprocatingly disposed in the hammer pivot cylinder 158, is pivotally connected to the hammer arm 142 generally near the end 146 of the hammer arm 142 via a pin 164 (FIG. 6). The hammer pivot cylinder 158 thus is connected to the hammer frame 120 and to the hammer arm 142 for pivotally moving the hammer arm 142 in the direction 154 when the rod 160 is reciprocatingly moved out of or away from the hammer pivot cylinder 158 and for pivotally moving the hammer arm 142 in the direction 156 when the rod 160 is reciprocatingly moved into the hammer pivot cylinder 158.

As shown in FIGS. 1, 2, 5 and 6, the second hammer arm assembly 110 includes a hammer arm 178 having opposite ends 180 and 182. A hammer plate 184 is secured to the hammer arm 178, generally near the end 180 thereof, and the hammer plate 184 is positioned on the hammer arm 178 to engage the nails for driving the nails into the second end 30 of the member 12, thereby nailing one of the end plates 14 to the end second end 30 of the member 12 in the nailing position of the second hammer arm assembly 110. The hammer arm 178 is pivotally connected to one end portion of an arm frame 186 (FIGS. 1, 2 and 6) via a pin 188 (FIGS. 1, 2 and 6) and, the opposite end of the arm frame 186 is secured to the hammer frame 120, generally at the second end 124 of the hammer frame 120, thereby pivotally securing the hammer arm 178 to the hammer frame 120 for pivotal movement in directions 190 and 192 (FIG. 6).

The second hammer pivot assembly 114 includes a hammer pivot cylinder 194 having one end of a rod 196 reciprocatingly disposed therein. The hammer pivot cylinder 194 is pivotally connected to the hammer frame 120, generally near the second end 124 of the hammer frame 120 via a pin 198 and the end of the rod 196, opposite the end of the rod 196 which is reciprocatingly disposed in the hammer pivot cylinder 194, is pivotally connected to the hammer arm 178, generally near the end 182 of the hammer arm 178 via a pin 200. The hammer pivot cylinder 194 thus is connected to the hammer frame 120 and to the hammer arm 178 for pivotally moving the hammer arm 178 in the direction 190 when the rod 196 is reciprocatingly moved out of or away from the hammer pivot cylinder 194 and for reciprocatingly or pivotally moving the hammer arm 178 in the direction 192 when the rod 196 is reciprocatingly moved into the hammer pivot cylinder 194.

As shown in FIGS. 1 and 2, the holding assembly 18 also includes a stop plate 202 having opposite ends 204 and 206. The end 204 of the stop plate 202 is pivotally connected to the support frame 48 generally near the first end 52 of the support frame 48 via a pin 208 (FIG. 1). The stop plate 202 is pivotally moveable in one direction to a stop position wherein the stop plate 202 extends substantially across one end portion of the support table 16 and is positioned to engage the first end 28 of the member 12 as the member 12 is moving in a direction 214 (FIGS. 1, 2 and 6) through the guide path 49 and across the support table 16 to prevent further movement of the member 12 in the direction 214 and to position the member 12 in a predetermined position on the support table 16. The stop plate 202 is also moveable in an opposite direction to a storage position wherein the stop plate 202 does not extend across any portion of the support table 16 and the member 12 is free to move in the direction 214 beyond the first end 45 of the support table 16.

The holding assembly 18 also includes a stop cylinder 216 (FIG. 1) having one end of a rod 218 (FIG. 2) reciprocatingly disposed therein. The end of the rod 218, opposite the end of the rod 218 which is reciprocatingly disposed in the stop cylinder 216, is pivotally connected to the end 204 of the stop plate 202 via a pin 220. The stop cylinder 216 is connected to the support frame 48, generally near the first end 52 of the support frame 48 via a pin 222. The stop cylinder 216 is connected to the stop plate 202 via the rod 218 and the stop cylinder 216 is supported on the support frame 48 such that, when the rod 218 is reciprocatingly moved away from or out of the stop cylinder 216, the stop plate 202 is moved to the stop position and such that, when the rod 218 is reciprocatingly moved into the stop cylinder 216, the stop plate 202 is pivotally moved to the storage position.

As shown in FIGS. 2 and 6, the support table 16 includes a plurality of cylindrically shaped rollers 224 (only some of the rollers 224 being designated via reference numerals in the drawings). Each end of the rollers is bearingly supported via a bearing block 226 (only some of the bearing blocks 226 being designated by a reference numeral in the drawings). The rollers 224 are spaced apart along the support table 16 generally between the opposite first and second ends 45 and 47 of the support table 16 and the bearing blocks 226 are secured to the support frame 48.

The support table 16 also includes a pair of guide rails 228 and 230 (FIG. 2). The guide rail 228 extends generally between the first and second ends 45 and 47 of the support table 16 and the guide rail 228 extends generally along one side of the rollers 224, the guide rail 228 also extending a distance generally above the rollers 224. The guide rail 230 extends generally between the first and second ends 45 and 47 of the support table 16 and the guide rail 230 extends generally along one side of the rollers 224, the guide rail 230 also extending a distance generally above the rollers 224. The guide rail 228 extends generally parallel with the guide rail 230 and the guide rail 228 is spaced a distance from the guide rail 230 with the rollers 224 being disposed generally between the guide rails 228 and 230. The guide rails 228 and 230 and the rollers 224 cooperate to define the guide path 49 extending generally between the opposite ends 45 and 47 of the support table 16.

The nailer 10 also includes a plurality of gears 240 (FIG. 1) (only some of the gears 240 being designated via reference numerals in the drawings). One of the gears 240 is secured to one end of each of the rollers 224. A drive chain 242 (FIGS. 1, 2, 3 and 4) extends about and is operatively connected to each of the gears 240. Another drive chain 244 (FIGS. 1 and 2) is operatively connected to one of the rollers 224 and the drive chain 244 also is operatively connected to a drive motor 246 (FIGS. 1 and 2).

Thus, when the drive motor 246 is activated to drivingly rotate the drive chain 244, the roller 224 connected to the drive chain 244 also is drivingly rotated. The driving rotation of the roller 224 which is connected to the drive chain 244 causes all of the rollers 224 to be drivingly rotated due to the connection between the rollers 224 provided via the drive chain 242. The drive motor 246 is adapted to drivingly rotate the drive chain 244 in a direction 248 thereby drivingly rotating the roller 224 which is connected to the drive chain 244 in the general direction 248. The rotation of the roller 224 which is connected to the drive chain 244 in the general direction 248 causes the drive chain 242 to be drivingly rotated in the general direction 248, thereby drivingly rotating the remaining rollers 224 in the general direction 248.

As shown in FIGS. 2 and 10, the first holding assembly 56 includes a side holding bar 270 which is connected to the support frame 48 generally near the first end 52 of the support frame 48. The side holding bar 270 is positioned to engage the side 34 of the member 12 when the horizontal holding cylinder 68 has moved the holding plate 74 to the holding position. The first holding assembly 56 also includes a bottom holding bar 274 which is connected to the support frame 48 generally near the first end 52 of the support frame 48. The bottom holding bar 274 is engageable with the lower surface 38 of the member 12, generally near the first end 28 of the member 12, and the bottom holding bar 274 cooperates to secure the first end 28 portion of the member 12 in a predetermined position when the vertical holding cylinder 60 of the first holding assembly 56 has been moved to the holding position wherein the holding plate 66 engages the upper surface 36 of the member 12, the first end 28 portion of the member 12 being compressed generally between the holding plate 66 of the vertical holding cylinder 60 of the first holding assembly 56 and the bottom holding bar 274.

As shown in FIGS. 2 and 10, the second holding assembly 58 includes a side holding bar 272 which is connected to the support frame 48, generally near the second end 54 of the support frame 48. The side holding bar 272 is positioned to engage the side 34 of the member 12 when the horizontal holding cylinder 88 has moved the holding plate 94 to the holding position. The second holding assembly 58 also includes a bottom holding bar 276 which is connected to the support frame 48, generally near the second end 54 of the support frame 48. The bottom holding bar 276 is engageable with the lower surface 38 of the member 12, generally near the second end 30 of the member 12, and the bottom holding bar 276 cooperates to secure the second end 30 portion of the member 12 in a predetermined position when the vertical holding cylinder 80 of the second holding assembly 58 has been moved to the holding position wherein the holding plate 88 engages the upper surface 36 of the member 12 generally near the second end 30 of the member 12, the second end 30 portion of the member 12 being compressed generally between the holding plate 86 of the vertical holding cylinder 80 of the second holding assembly 58 and the bottom holding bar 276.

In operation, the vertical holding cylinder 60, the horizontal holding cylinder 68, the vertical holding cylinder 80 and the horizontal holding cylinder 88 each are actuated to move the respective holding plates 66, 74, 86 and 94 to the storage position. The hammer mover cylinder 134 is actuated to move the hammer frame 120 to the storage position and the hammer pivot cylinders 158 and 194 each are actuated to move the respective hammer arms 142 and 178 to the storage position. The stop cylinder 216 is actuated to move the stop plate 202 to the stop position wherein the stop plate 202 extends substantially across one end of the guide path 49, generally near the first end 52 of the support frame 48. Then, the drive motor 246 is activated to drivingly rotate the drive chain 244 in the direction 248 thereby causing the drive chain 242 and the rollers 224 are connected thereto to be drivingly rotated in the general direction 248.

After the drive motor 246 has been activated to drivingly rotate the rollers 224, the first end 28 portion of the member 12 is disposed in the guide path 49 generally between the guide rails 228 and 230, to a position wherein the first end 28 portion of the member 12 engages and is disposed on the roller 224 nearest the second end 52 of the support frame 48. Since the rollers 224 are being drivingly rotated via the drive motor 246, the rollers 224 drivingly move the member 12 along the guide path 49 in the direction 214 from the second end 45 of the guide path 49 toward the first end 46 of the guide path 49. The rollers 224 continue to move the member 12 along the guide path 49 in the direction 214 to a position wherein the first end 28 of the member 12 engages the stop plate 202, the stop plate 202 cooperating to prevent further movement of the member 12 in the direction 214 along the guide path 49 and to position the member 12 in the guide path 49 extending generally between the opposite ends 45 and 47 of the guide path 49 and generally between the opposite ends 52 and 54 of the support frame 48. In this position, the member 14 is disposed on the support table 16 with the first end 28 of the member 12 disposed near the first end 45 of the guide path 49 and near the first end 52 of the support frame 48 and with the second end 30 of the member 12 disposed near the second end 47 of the guide path 49 and near the second end 54 of the support frame 48.

After the member 12 has been positioned in the guide path 49 via the engagement with the stop plate 202, the drive motor 246 is deactivated and thus the rollers 224 cease to drivingly move the member 12 in the direction 214. Since the guide rails 228 and 230 extend above the rollers 224, the guide rails 228 and 230 cooperate to engage the sides 32 and 34 of the member 12 to retain the member 12 within the guide path 49 as the member 12 is being moved in the direction 214 via the rollers 224. The guide rails 228 and 230 are spaced a distance apart which is greater than the distance between the first and the second sides 32 and 34 of the member 12 so that the guide rails 230 and 232 do not slidingly engage the member 12 at all times as the member 12 is being drivingly moved in the direction 214 along the guide path 49.

After the member 12 has been positioned in the guide path 49 by the stop plate 202, the stop cylinder 216 is actuated to pivotally move the stop plate 202 to the storage position. In this position of the member 12, the member 12 is disposed in the guide path 49 and extends across the support table 16 generally between the first and the second ends 52 and 54 of the support frame 48, the first end 28 of the member 12 extending a predetermined distance beyond the first end 52 of the support frame 48 and the second end 30 of the member 12 extending a predetermined distance beyond the second end 54 of the support frame 48.

After the member 12 has been positioned in the guide path 49 via the stop plate 202 and the stop plate 202 has been moved to the storage position, the vertical holding cylinder 60 is actuated to move the holding plate 66 to the holding position wherein the holding plate 66 engages a portion of the upper surface 36 of the member 12, generally near the first end 28 of the member 12 and the horizontal holding cylinder 68 is actuated to move the holding plate 74 to the holding position wherein the holding plate 74 engages a portion of the first side 32 of the member 12, generally near the first end 28 of the member 12. In this position, a portion of the side 34 of the member 12, generally near the first end 28 of the member 12, engages a portion of the side holding bar 270 and the horizontal holding cylinder 68 is positioned so that the holding plate 74 applies a force to the first side 32 of the member 12 in a direction 300 (shown in FIG. 10), thereby compressing the first end 28 portion of the member 12 generally between the holding plate 74 and the side holding bar 270 to move the split portions of the member 12 formed by the split or opening 40 in the first end 28 portion of the member 12 together or, in other words, generally back to the original positions of such split portions prior to the formation of the split or opening 40 in the member 12. The vertical holding cylinder 60 is positioned so that the holding plate 66 applies a force to the upper surface 36 of the member 12, generally near the first end 28 portion of the member 12, in a direction 302 (shown in FIG. 10), thereby compressing the first end 28 portion of the member 12 generally between the holding plate 66 and the bottom holding bar 274 to cooperate in securedly holding the member 12 in position during the nailing operation.

After the member 12 has been positioned in the guide path 232 via the stop plate 202 and the stop plate 202 has been moved to the storage position, the vertical holding cylinder 80 is actuated to move the holding plate 86 to the holding position wherein the holding plate 86 engages a portion of the upper surface 36 of the member 12, generally near the second end 30 of the member 12 and the horizontal holding cylinder 88 is actuated to move the holding plate 94 to the holding position wherein the holding plate 94 engages a portion of the first side 32 of the member 12, generally near the second end 30 of the member 12. In this position, a portion of the second side 34 of the member 12, generally near the second end 30 of the member 12, engages a portion of the side holding bar 272 and the horizontal holding cylinder 88 is positioned so that the holding plate 94 applies a force to the first side 32 of the member 12 in the direction 300 (shown in FIG. 10), thereby compressing the second end 30 portion of the member 12, generally between the holding plate 94 and the side holding bar 272 to move the split portions of the member 12 formed by the split or opening 42 in the second end 30 portion of the member 12 together or, in other words, generally back to the original positions of such split portions prior to the formation of the split or opening 42 in the member 12. The vertical holding cylinder 80 is positioned so that the holding plate 86 applies a force to the upper surface 36 of the member 12, generally near the second end 30 portion of the member 12, in the direction 302 (shown in FIG. 10), thereby compressing the second end 30 portion of the member 12 generally between the holding plate 86 and the bottom holding bar 276 to cooperate in securedly holding the member 12 in position during the nailing operation.

After the vertical holding cylinders 60 and 80 and the horizontal holding cylinders 68 and 88 have each been actuated to move the respective holding plates 66, 86, 74 and 94 to the holding positions, a nail plate 14 is disposed generally adjacent the first end 28 of the member 12 and another nail plate 14 disposed generally adjacent the second end 30 of the member 12. Each of the nail plates 14 are oriented so that the nails 46 of each of the nail plates 14 are disposed generally adjacent the respective ends 28 and 30 of the member 12.

After the nail plates 14 have been positioned adjacent the ends 28 and 30 of the member 12, the hammer mover cylinder 134 is actuated to move the hammer frame 120 in the direction 130 to the nailing position. After the hammer frame 120 has been moved to the nailing position, the hammer pivot cylinder 158 is actuated to pivotally move the hammer arm 142 in the direction 156 and the hammer pivot cylinder 194 is actuated to move the hammer arm 178 in the direction 190. The hammer pivot cylinder 158 continues to move the hammer arm 142 in the direction 154 to a position wherein the hammer plate 148 engages the nail plate 14 disposed generally adjacent the first end 28 of the member 12 and drives the nails 46 of such nail plate 14 into the first end 28 of the member 12 thereby securing the nail plate 14 in the first end 28 of the member 12. At the same time, the hammer pivot cylinder 194 continues to move the hammer arm 178 in the direction 190 to a position wherein the hammer plate 184 engages the nail plate 14 disposed generally adjacent the second end 30 of the member 12 and the hammer pivot cylinder 158 continues to move the hammer plate 184 in the direction 154 so that the hammer plate 184 engages the nail plate 14 and drives the nails 46 into the second end 30 of the member 12. After the first and the second hammer assemblies 100 and 102 have been operated to nail the nail plates 14 in the respective ends 28 and 30 of the member 12, the hammer pivot cylinders 158 and 194 each are actuated to move the hammer arm 142 and 178, respectively, in the direction 154 thereby moving the hammer plates 148 and 184 generally away from the respective ends 28 and 30 of the member 12. After the hammer plates 148 and 184 have been moved in the directions 156 and 192 away from the ends 28 and 30 of the member 12, the hammer mover cylinder 134 is actuated to move the hammer frame 120 in the direction 132 to a position wherein the hammer frame 120 is disposed in the storage position.

After the hammer frame 120 has been moved to the storage position, the vertical holding cylinders 60 and 80 each are actuated to move the respective holding plates 66 and 86 to the storage positions and the horizontal holding cylinders 68 and 88 each are actuated to move the respective holding plates 74 and 94 to the storage positions. After the holding plates 66, 74, 86 and 94 each have been moved to the storage positions, the drive motor 246 is activated to drivingly rotate the rollers in the direction 248, the rollers 224 drivingly moving the member 12 in the direction 214 to remove the member 12 from the support table 16.

The cylinders 60, 68, 80, 88, 134, 158, 194 and 216 each of the type commonly referred to in the art as "hydraulic cylinders", and the construction and operation of such hydraulic cylinders is well known by those skilled in the art. The hydraulic circuit (not shown in the drawings) for controlling the vertical holding cylinders 60 and 80, the horizontal holding cylinders 68 and 88, the hammer mover cylinders 134 and 170, the hammer pivot cylinder 158 and 194 and the stop cylinder 216 includes a pump and a hydraulic reservoir. Both sides of each of the cylinders 60, 68, 80, 88, 134, 158, 170, 194 and 216 is connected to the pump and to the hydraulic fluid reservoir by way of individual manually controlled valves. Each valve is structured and connected to the respective hydraulic cylinders 60, 68, 80, 88, 134, 158, 170, 194 and 216 such that, in one position of each of the valves, the pump is connected to one side of the respective hydraulic cylinders 60, 68, 80, 88, 134, 158, 170, 194 and 216 and such that, in another position of each of the valves, the opposite side of the respective hydraulic cylinders 60, 68, 80, 88, 134, 158, 170, 194 and 216 is connected to the pump. In each instance, the side of the respective hydraulic cylinders, opposite the side connected to the pump, is connected to the hydraulic fluid reservoir. Thus, the present hydraulic circuit contemplates individual control valves for each of the cylinders 60, 68, 80, 88, 134, 158, 170, 194 and 216 for manually operating each of the respective hydraulic cylinders 60, 68, 80, 88, 134, 158, 170, 194 and 216 to reciprocatinly remove the respective rods into and out of or away from the respective cylinders 60, 68, 80, 88, 134, 158, 170, 194 and 216. In one other embodiment, the valves which are connected to the hydraulic cylinders 60, 68, 80, 88, 134, 158, 170, 194 and 216 could be electrically operated and the nailer 10, in this instance, could include a control circuit for automatically positioning each of the hydraulic cylinders 60, 68, 80, 88, 134, 158, 170, 194 and 216 in the proper position as described before in connection with each step of the operation of the nailer 10. Hydraulic cylinders and valves and control circuits for operating such hydraulic cylinders are well known in the art and a detailed description of the construction and operation of such components is not deemed necessary herein.

It should be noted that, although the present invention has been described with two hammer assemblies 100 and 102 for nailing a nail plate 14 in each end 28 and 30 of a member 12, a nailer 10 could incorporate only one of the hammer assemblies 100 and 102 for nailing a nail plate 14 in one end 28 or 30 of the member 12, if desired in a particular application.

Changes may be made in the construction and the operation of each of the elements, components and assemblies of the nailer 10 as described herein without departing from the spirit and the scope of the invention as defined in the following claims.

What is claimed is:

1. A nailer for nailing a nail plate to a member, a plurality of nails being secured to the nail plate and the member thereby nailing the nail plate to the member, the nailer comprising:

a support table having a portion adapted to receive and support the member;

a support frame connected to the support table for supporting the support table in a predetermined elevated position;

a holding assembly for holding the member in a predetermined position when the member is supported on the support table prior to nailing the nail plate to the member; and at least one hammer assembly for applying a force to the nails to nail the nail plate to the member, comprising:

a hammer arm assembly pivotally secured to the support frame, the hammer arm assembly being pivotally moveable to a storage position and to a nailing position;

a hammer mover assembly connected to the hammer arm assembly for pivotally moving the hammer arm assembly to the storage position and to the nailing position; and a hammer pivot assembly for moving the hammer arm assembly into engagement with the nails for driving the nails into the member when the hammer arm assembly is in the nailing position, thereby nailing the nail plate to the member.

2. The nailer of claim 1 wherein the support frame is defined further as having a first end and a second end, and wherein the support table is defined further as having a first end and a second end, the support table extending generally between the first and the second ends of the support frame with the first end of the support table being disposed near the first end of the support frame and the second end of the support table being disposed near the second end of the support frame, a portion of the support table being adapted to define a guide path, the member being moved on the support table within the guide path.

3. The nailer of claim 1 wherein the nailer is adapted to nail the nail plate to the member having a first end and a second end, a first side and a second side, an upper surface and a lower surface, and wherein the holding assembly is defined further as holding the member in a predetermined position extending generally between the first and second ends of the support table for nailing a nail plate to at least one of the first and second ends of the member.

4. The nailer of claim 3 wherein the hammer assembly is defined further to include:

a first hammer assembly, comprising a hammer arm assembly, and a hammer pivot assembly, for applying a force to the nails to nail a plate to the first end of the member, the hammer arm assembly being pivotally secured to the support frame generally near the first end of the support frame, the hammer arm assembly being disposed generally near the first end of the support table and the hammer arm assembly being pivotally moveable to a storage position and to a nailing position;

the hammer mover assembly being connected to the hammer arm assembly for pivotally moving the hammer arm assembly to the storage position and to the nailing position; and the hammer pivot assembly being adapted for moving the hammer arm assembly into engagement with the nails for driving the nails into the member when the hammer arm assembly is in the nailing position, thereby nailing the nail plate to the first end of the member; and a second hammer assembly, comprising a hammer arm assembly, and a hammer pivot assembly, for applying a force to nail a nail plate to the second end of the member, the hammer arm assembly being pivotally secured to the support frame generally near the second end to the support frame, the hammer arm assembly being disposed generally near the second end of the support table and the hammer arm assembly being pivotally moveable to a storage position and to a nailing position;

the hammer mover assembly being connected to the hammer arm assembly for pivotally moving the hammer arm assembly to the storage position and to the nailing position; and the hammer pivot assembly being adapted for moving the hammer arm assembly into engagement with the nails for driving the nails into the member when the hammer arm assembly is in the nailing position, thereby nailing the nail plate to the second end of the member.

5. The nailer of claim 4 wherein the hammer mover assembly is defined further to include:

a hammer frame having a first end and a second end, the first end of the hammer frame being disposed near the first end of the support table and the second end of the hammer frame being disposed near the second end of the support table, the hammer frame being pivotally connected to the support frame for movement in one direction to move the first and the second hammer arm assemblies to the storage position and pivotally moveable in an opposite direction to move the first and the second hammer assemblies to the nailing position, the hammer frame extending generally between the first and the second ends of the support frame, the first hammer assembly being connected to the hammer frame generally near the first end of the hammer frame and the second hammer assembly being connected to the hammer frame generally near the second end of the hammer frame; and a hammer mover cylinder having a rod reciprocatingly disposed therein, the hammer mover cylinder being connected to the support frame and the rod being connected to the hammer frame, the hammer mover cylinder moving the hammer frame in one direction when the rod is reciprocatingly moved into the hammer mover cylinder to move the hammer frame and the first and the second hammer assemblies connected thereto to the storage position and the hammer mover cylinder moving the hammer frame in the opposite direction for moving the first and the second hammer assemblies connected thereto to the nailing position when the rod of the hammer mover cylinder is reciprocatingly moved out of the hammer mover cylinder.

6. The nailer of claim 5 wherein the first hammer arm assembly is defined further to include:

a hammer arm having opposite ends, the hammer arm being pivotally connected to the first end of the hammer frame; and a hammer plate connected to one end of the hammer arm of the first hammer arm assembly, the hammer plate being positioned and adapted to engage the nails for driving the nails into the first end of the member for nailing the nail plate to the first end of the member; and wherein the second hammer arm assembly is defined further to include:

a hammer arm having opposite ends, the hammer arm being pivotally connected to the second end of the hammer frame; and a hammer plate connected to one end of the hammer arm of the second hammer arm assembly, the hammer plate being positioned and adapted to engage the nails for driving the nails into the second end of the member for nailing the nail plate to the second end of the member.

7. The nailer of claim 6 wherein the first hammer pivot assembly is defined further to include:

a hammer pivot cylinder having a rod reciprocatingly disposed therein, the hammer pivot cylinder being connected to the hammer frame and the rod being connected to the end of the hammer arm of the first hammer arm assembly, opposite the end of the hammer arm of the first hammer arm assembly having the hammer plate connected thereto, the hammer pivot cylinder pivotally moving the hammer arm in one direction when the rod is moved out of the hammer pivot cylinder for moving the hammer plate into engagement with the nails, the hammer plate driving the nails into the first end of the member for nailing the nail plate to the first end of the member.

8. The nailer of claim 7 wherein the second hammer pivot assembly further includes, a hammer pivot cylinder having a rod reciprocatingly disposed therein, the hammer pivot cylinder being connected to the hammer frame and the rod being connected to the end of the hammer arm of the second hammer arm assembly, opposite the end of the hammer arm of the second hammer arm assembly having the hammer plate connected thereto, the hammer pivot cylinder pivotally moving the hammer arm in one direction when the rod is moved out of the hammer pivot cylinder for moving the hammer plate into engagement with the nails, the hammer plate driving the nails into the second end of the member for nailing the nail plate to the second end of the member.

9. The nailer of claim 4 wherein the holding assembly is defined further to include:

a first holding assembly for holding the first end portion of the member in a predetermined position prior to nailing the nail plate to the first end member; and a second holding assembly for holding the second end portion of the member in a predetermined position prior to nailing the nail plate to the second end of the member.

10. The nailer of claim 9 wherein the first holding assembly comprises a horizontal holding cylinder, a holding plate and a side holding bar, the horizontal holding cylinder having a rod reciprocatingly disposed therein;

the holding plate being connected to the end of the rod, opposite the end of the rod reciprocatingly disposed in the horizontal holding cylinder, the horizontal holding cylinder being connected to the support frame and positioned such that the rod and the holding plate connected thereto can be reciprocatingly moved toward the cylinder to a storage position and such that the rod and the holding plate connected thereto can be moved away from the cylinder to a holding position wherein the holding plate engages a portion of the first side of the member, generally near the first end of the member; and the side holding bar being connected to the support frame and disposed a distance from the holding plate connected to the horizontal holding cylinder of the first holding assembly, the side holding bar engaging a portion of the second side of the member, generally near the first end of the member, and the holding plate connected to the rod of the horizontal holding cylinder of the first holding assembly engaging the first side portion of the member generally near the first end of the member in the holding position of the holding plate, the first end portion of the member being compressingly held generally between the side holding bar and the holding plate connected to the rod of the horizontal holding cylinder of the first holding assembly in a holding position of the horizontal holding cylinder of the first holding assembly; and wherein the second holding assembly comprises a horizontal holding cylinder, a holding plate and a side holding bar, the horizontal holding cylinder having a rod reciprocatingly disposed therein;

the holding plate being connected to the end of the rod, opposite the end of the rod reciprocatingly disposed in the horizontal holding cylinder, the horizontal holding cylinder being connected to the support frame and positioned such that the rod and the holding plate connected thereto can be reciprocatingly moved toward the cylinder to a storage position and such that the rod and the holding plate connected thereto can be moved away from the cylinder to a holding position wherein the holding plate engages a portion of the first side of the member, generally near the second end of the member; and the side holding bar being connected to the support frame and disposed a distance from the holding plate connected to the horizontal holding cylinder of the second holding assembly, the side holding bar engaging a portion of the second side of the member, generally near the second end of the member and the holding plate connected to the rod of the horizontal holding cylinder of the second holding assembly engaging a portion of the first side of the member, generally near the second end of the member, in the holding position of the holding plate, the second end portion of the member being compressed generally between the side holding bar and the holding plate connected to the rod of the horizontal holding cylinder of the second holding assembly in a holding position of the horizontal holding cylinder of the first holding assembly.

11. The nailer of claim 10 wherein the first holding assembly comprises a vertical holding cylinder, a bottom holding bar, and a holding plate, the vertical holding cylinder having a rod reciprocatingly disposed therein;

the bottom holding bar being connected to the support frame and being engageable with a portion of the lower surface of the member, generally near the first end of the member; and the holding plate being connected to the end of the rod, opposite the end of the rod reciprocatingly disposed in the vertical holding cylinder, the vertical holding cylinder of the first holding assembly being connected to the support frame and positioned and adapted to move the holding plate to a storage position wherein the holding plate is disposed a distance above the upper surface of the member and to a holding position wherein the holding plate engages a portion of the upper surface of the member generally near the first end of the member, the member being compressingly held between the bottom holding bar and the holding plate of the vertical holding cylinder of the first holding assembly in the holding position of the first holding assembly; and wherein the second holding assembly comprises a vertical holding cylinder, a bottom holding bar and a holding plate, the vertical holding cylinder having a rod reciprocatingly disposed therein;

the bottom holding bar being connected to the support frame and being engageable with a portion of the lower surface of the member, generally near the second end of the member; and the holding plate being connected to the end of the rod, opposite the end of the rod reciprocatingly disposed in the vertical holding cylinder, the vertical holding cylinder of the second holding assembly being connected to the support frame and positioned and adapted to move the holding plate to a storage position wherein the holding plate is disposed a distance above the upper surface of the member and to a holding position wherein the holding plate engages a portion of the upper surface of the member generally near the second end of the member, the member being compressingly held between the bottom holding bar and the holding plate of the vertical holding cylinder of the second holding assembly in the holding position of the second holding assembly.

12. The nailer of claim 3 wherein the holding assembly is defined further to include:

a stop plate pivotally connected to the support frame and being disposed generally near the first end of the support table, the stop plate being pivotally moveable to a stop position wherein the stop plate extends across a portion of the guide path, generally near the first end of the support table and the stop plate being pivotally moveable in an opposite direction to a storage position wherein the stop plate is removed from the guide path; and a stop cylinder having a rod reciprocatingly disposed therein, the stop cylinder being connected to the support frame and the end of the rod, opposite the end of the rod reciprocatingly disposed in the stop cylinder, being connected to the stop plate, the stop cylinder being adapted to pivotally move the stop plate to the storage position when the rod is reciprocatingly moved into the stop cylinder and to move the stop plate to the stop position when the rod is reciprocatingly moved away from the stop cylinder, the stop plate being engageable with the first end of the member to limit the movement of the member in one direction along the guide path for positioning the member in a predetermined position on the support table extending generally between the first and the second ends of the support table.

13. The nailer of claim 12 wherein the support table is defined further to include:

a plurality of rollers, each of the rollers being bearingly supported on the support frame and the rollers being spaced along the guide path generally between the first and the second ends of the support table;

a drive motor supported on the support frame and being adapted to cooperate in drivingly rotating the rollers; and means connected to the drive motor and to each of the rollers for drivingly rotating the rollers, the rollers cooperating to move the member across the support table in one direction from the second end toward the first end of the support table when the rollers are drivingly rotating the stop plate limiting the movement of the member in the direction from the second end toward the first end of the support table in a stop position of the stop plate.

14. The nailer of claim 13 wherein the support table is defined further to include: a pair of guide rails, one of the guide rails extending along one side of the guide path generally between the first and the second ends of the support table and the other guide rail being disposed generally on the opposite side of the guide path and extending generally between the first and the second ends of the support table, the guide rails being engageable with the member and the guide rails being positioned to cooperate in holding the member within the guide path as the member is moved through the guide path generally from the second end and toward the first end of the support table.

* * * * *